US006036455A

United States Patent [19]

Ciccarelli

[11] Patent Number: 6,036,455

[45] Date of Patent: Mar. 14, 2000

[54] MOTOR FRAME ASSEMBLY WITH ALIGNMENT FEATURES

[75] Inventor: Robert A. Ciccarelli, Kent, Ohio

[73] Assignee: Ametek, Inc., Kent, Ohio

[21] Appl. No.: 09/074,365

[22] Filed: May 7, 1998

[51] Int. Cl.[7] ..... F04B 17/00

[52] U.S. Cl. ..... 417/423.14; 415/206

[58] Field of Search ..... 417/423.14; 415/214.1, 415/206; 403/335

[56] References Cited

U.S. PATENT DOCUMENTS 4,630,994 12/1986 Gross ..... 415/190

5,716,200 2/1998 Mirumachi et al. ..... 417/360

*Primary Examiner*—Henry Bennett
*Assistant Examiner*—Malik N. Drake
*Attorney, Agent, or Firm*—Renner, Kenner, Greive, Bobak, Taylor & Weber

[57] ABSTRACT

A motor frame assembly includes a motor housing having an end, a fan end bracket having a bracket shiplap, and a blower assembly having a blower shiplap. The end, the bracket shiplap and the blower shiplap alignable with each other to form a nested connection that provides at least radial and axial alignment for the motor frame assembly to facilitate the manufacturing process and provide a long-lasting motor frame assembly.

9 Claims, 3 Drawing Sheets

MOTOR FRAME ASSEMBLY WITH ALIGNMENT FEATURES

TECHNICAL FIELD

The present invention herein resides in the art of motor frame assemblies. More particularly, the present invention relates to motor frame assemblies with alignment features. Specifically, the present invention relates to motor frame assemblies with axial, radial and angular alignment therebetween.

BACKGROUND ART

Motor frame assemblies are employed in floor care equipment or other devices which require use of blower fans. Common motor frame assemblies are made from a three-piece construction consisting of a fan end bracket, a blower shell and a motor housing. Generally, the motor frame is assembled by inserting a motor with an axial shaft into the fan end bracket. A blower fan is then secured to the end of the motor shaft extending through the fan end bracket and enclosed by the blower shell. Next, the motor is enclosed by the motor housing which fits over the fan end bracket and at least a portion of the blower shell. The fan end bracket, the blower shell and the motor housing are then positively secured to one another by fasteners.

The above assembly relies on various-height and various-location individual contact points supported by brackets, in axial load, to ensure a secure and seated fit between all three pieces. Due to the highly-irregular shapes of the three pieces, which are typically made of molded thermoplastic or thermoset material, the brackets vary in size due to shrinkage, which results in inadequate seating of the three pieces in the final assembly. As a result, the motor armature core rubs against the field core, requiring hand-fitting of the motors into the motor frame assembly. As will be appreciated, this situation is not conducive for high-volume production.

When the above motor frame assembly pieces are secured to one another, other alignment problems became apparent. In particular, the ball bearings, which are fitted upon the motor shaft between the pieces, would not be properly aligned with the motor shaft, causing bearing stress, added noise and short bearing life. Moreover, this misalignment increases the vibration of the motor frame assembly, causing the fasteners which hold the three pieces together to absorb vibrational stress. Ultimately, this vibrational stress causes the fasteners to loosen and further harm operation of the motor within the assembly.

Based upon the foregoing, there is a need in the art for a motor frame assembly with alignment features. Moreover, there is a need in the art for a motor frame assembly which provides axial, radial and angular alignment with respect to the three assembled pieces of a motor frame assembly.

DISCLOSURE OF INVENTION

In light of the foregoing, it is a first aspect of the present invention to provide a motor frame assembly with alignment features.

Another aspect of the present invention is to provide a motor frame assembly in which a fan end bracket, a blower shell and a motor housing are secured to one another through a nested connection which provides axial, radial and angular alignment.

Yet another aspect of the present invention, as set forth above, is to provide the fan end bracket, the blower shell and the motor housing with axial, radial and angular alignment with respect to its mating part, or in the alternative, with respect to each of the other two mating parts.

Still another aspect of the present invention, as set forth above, is to provide modified shiplap joints between each of the three pieces to provide a relatively smooth inner surface between the fan end bracket and the blower shell when nested with one another so as to minimize air turbulence within the blower shell.

A further aspect of the present invention, as set forth above, is to improve the assembly of the three pieces and, accordingly, increase production rates for the motor frame assembly.

Yet a further aspect of the present invention, as set forth above, is to provide proper alignment for all other related parts that fit within the motor frame assembly such as the bearing, the motor field winding and the motor armature winding.

Still a further aspect of the present invention, as set forth above, is to reduce the vibration of the motor frame assembly by providing a positive and secure fit between all three pieces thereof.

The foregoing and other aspects of the present invention shall become apparent as the detailed description proceeds are achieved by a motor frame assembly, comprising a motor housing having an end, a fan end bracket having a bracket shiplap, and a blower assembly having a blower shiplap, the end, the bracket shiplap and the blower shiplap alignable with each other to form a nested connection that provides at least radial and axial alignment with each other.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
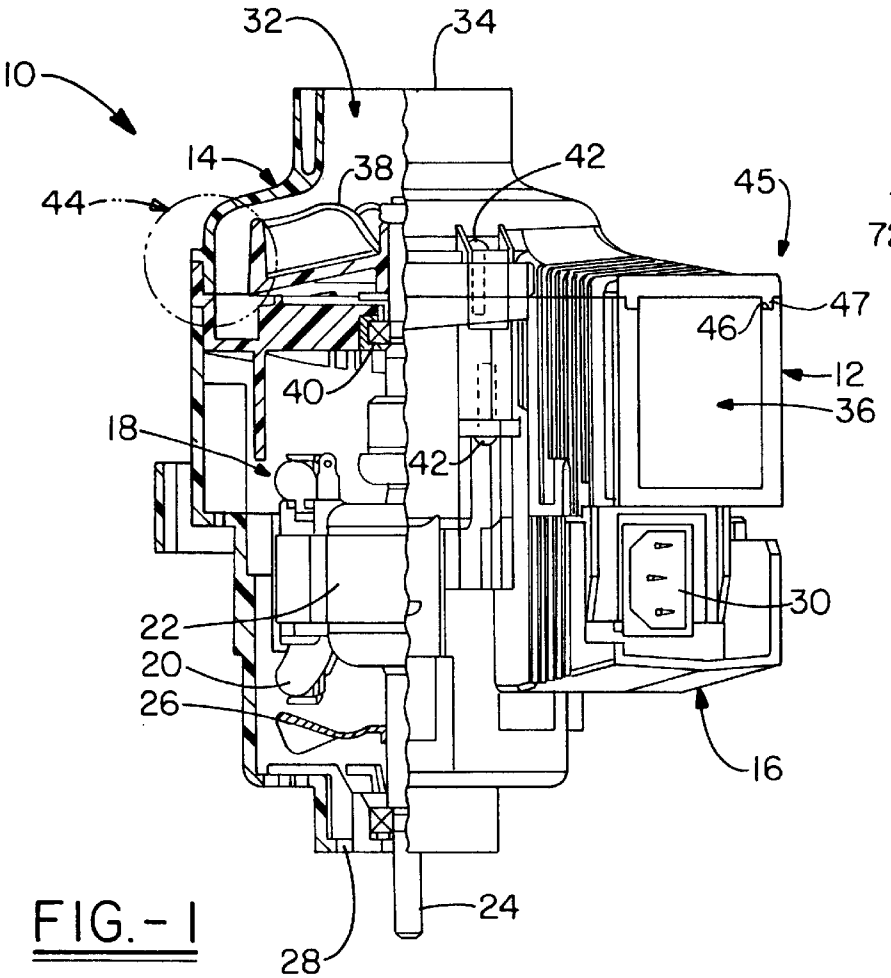
FIG. 1 is a partial cross-sectional view of a motor frame assembly according to the present invention.

Referring now to the drawings and more particularly to FIG. 1, it can be seen that a motor frame assembly, according to the present invention, is designated generally by the numeral 10. As shown, the assembly 10 includes a fan end bracket 12 that is matable with a blower shell 14. A motor housing 16 encloses the fan end bracket 12 and is disposed on a side opposite the blower shell 14. As those skilled in the art will appreciate, a motor 18 is received within the motor housing 16. The motor 18 includes a field winding 20 and an armature winding 22. A shaft 24 axially extends from the motor 18 through one end of the motor housing 16 in one direction and through the fan end bracket 12 into the blower shell 14 in an opposite direction. A cooling fan 26 may be disposed on the shaft 24 in the motor housing 16. The motor housing 16 provides a plurality of housing openings 28 to allow for cooling air to be circulated by the cooling fan 26 over the field and armature windings 20 and 22, respectively.

A receptacle 30 is provided by the motor housing 16 to allow for electrical connection to the field winding 20 and armature winding 22.

The fan end bracket 12 and blower shell 14, when assembled to one another, form a chamber 32 for moving working air from a working air inlet 34 to a working air outlet 36. This is accomplished by a working fan 38 which is mounted to the shaft 24 which rotates in a bearing 40 mounted in the fan end bracket 12. The skilled artisan will appreciate that the assembly 10 is a generally cylindrical construction and that the receptacle 30 and the working air outlet 36 extend tangentially therefrom. Once the components of the assembly 10 are fitted to one another, they are secured and held in place by a plurality of fasteners 42. It will be appreciated that a first series of fasteners are employed to secure the blower shell 14 to the motor housing 16 and that a second series of fasteners are employed to secure the fan end bracket 12 to the motor housing 16. The first and second series of fasteners are distributed around the cylindrical periphery of the motor frame assembly 10.

In order to properly align the fan end bracket 12, the blower shell 14 and the motor housing 16 with respect to at least its adjacent piece and/or the other two pieces, a nested connection 44 is provided at least around the cylindrical periphery of the motor frame assembly 10. As will be described in further detail hereinbelow, the nested connection 44 provides axial, radial and angular alignment between the fan end bracket 12, the blower shell 14 and the motor housing 16 in such a manner to facilitate assembly thereof, ensure proper alignment of the components within the assembly 10 and to reduce undesirable stresses within the assembly.

A nested connection 45, which provides radial and axial alignment, is provided along the tangential extension where just the fan end bracket 12 mates with the blower shell 14. In particular, the fan end bracket provides a channel 46 which receives a ridge 47 extending from the blower shell 12.

Figure 2:
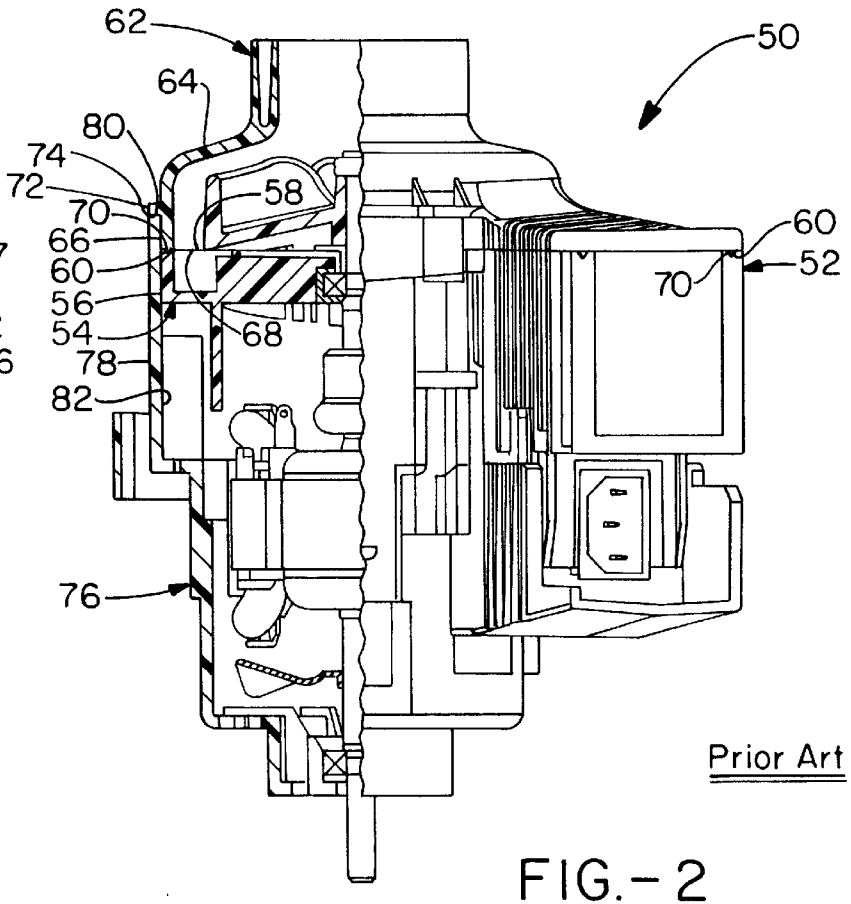
Prior Art FIG.-2
FIG. 2 is a partial cross-sectional view of a motor frame assembly according to the prior art.

Referring now to FIG. 2, a prior art motor fan assembly is presented in which all three of the major components are not radially, axially and angularly aligned with one another. In particular, a fan end bracket 52 includes a collar 54 which has a collar outer surface 56 that terminates at an edge 58. Disposed along the periphery of the edge 58 is an alignment groove 60. A blower shell 62 is mated to the fan end bracket 52. The blower shell 62 includes a shoulder 64 which provides a shoulder outer surface 66 that terminates at an edge 68. Extending from the periphery of the blower shell 62 along the edge 68 is an aligning rib 70. Extending outwardly from the shoulder outer surface 66 is a rib 72 which provides a stop edge 74. A motor housing 76 is received over the fan end bracket 52. The motor housing 76 includes an end 78 which provides an edge 80 from which extends an inner surface 82.

When assembled to one another, the aligning groove 60 of the fan end bracket 52 receives the aligning rib 70 of the blower shell 62. It will be appreciated that guiding the rib 70 into the groove 60 is a difficult task primarily due to the manner in which certain parts of the blower shell and the fan end bracket shrink when withdrawn from their respective molds. The motor housing 76 is disposed over both the fan end bracket 52 and the blower shell 62 once they are aligned. The end 78 is positioned at least adjacent the stop edge 74 of the blower shell 62. As can be seen from FIG. 2, there is no axial alignment provided between the motor housing 76 and the fan end bracket 52. Although radial and axial alignment is provided between the fan end bracket 52 and the blower shell 62, the aligning rib 70 and the aligning groove 60 do not provide positive and secure mating between the two parts during assembly due to shrinkage.

Figure 3:
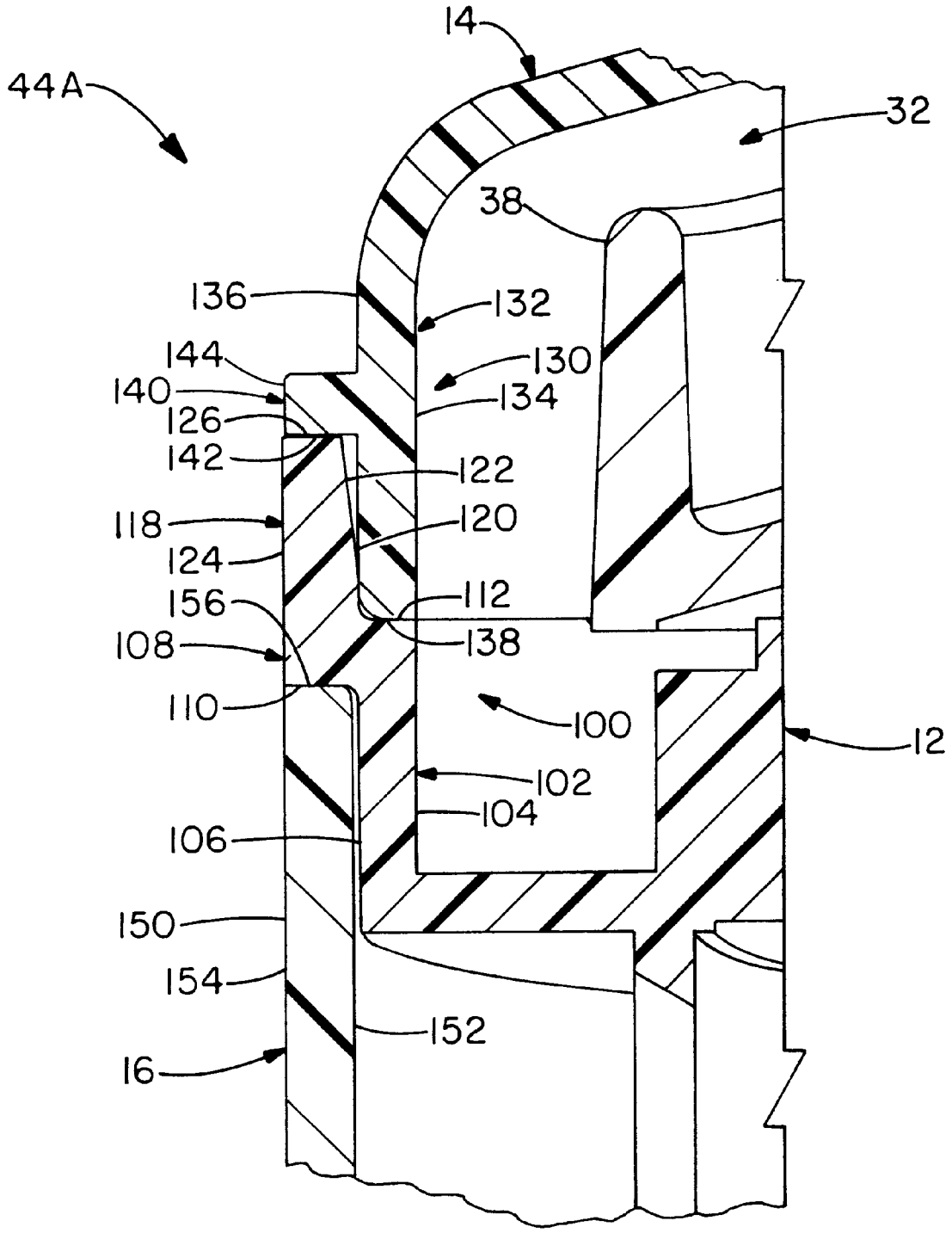
FIG. 3 is an enlarged cross-sectional view of a nesting connection according to the present invention.

To overcome the problems noted in the Background Art and the prior art representation shown in FIG. 2, reference is now made to FIG. 3 which shows a nested connection 44A in detail. The fan end bracket 12 includes a modified bracket shiplap 100 that is employed to interconnect the fan end bracket 12 to the blower shell 14 and to the motor housing 16. The bracket shiplap 100 includes a collar 102 which provides a collar inner surface 104 opposite a collar outer surface 106. Extending substantially perpendicularly outwardly from the collar 102 is a rim 108 which provides a rim surface 110 opposite a collar end surface 112. Extending substantially perpendicularly and upwardly away from the rim 108 is a finger 118. The finger 118 provides a finger inner surface 120 from which extends a taper surface 122. The finger 118 also provides a finger outer surface 124 that is opposite both the finger inner surface 120 and the taper surface 122. The finger outer surface 124 and the taper surface 122 are joined to one another by a finger edge 126. It will be appreciated that the taper surface 122 assists in aligning and guiding the blower shell 14 onto the fan end bracket 12.

The blower shell 14 provides a modified blower shiplap 130 that is matable with the bracket shiplap 100. The blower shiplap 130 includes a shoulder 132 which provides a shoulder inner surface 134 opposite a shoulder outer surface 136. A shoulder edge 138 joins the shoulder inner surface 134 to the shoulder outer surface 136. A rib 140 extends substantially perpendicularly outwardly from the shoulder outer surface 136 at a position away from the shoulder edge 138. The rib 140 includes a stop edge 142 that is substantially perpendicular to the shoulder outer surface 136. The rib 140 also includes a rib surface 144 that is substantially perpendicular to the stop edge 142.

It can be seen that when the blower shell 14 is mated with the fan end bracket 12 an axial and radial alignment is created therebetween. In particular, the shoulder edge 138 is placed adjacent to and bears upon the collar end surface 112 while the stop edge 142 is placed adjacent to and bears upon the finger edge 126. Accordingly, the finger inner surface 120 is positioned adjacent and may bear upon the shoulder outer surface 136. It will also be appreciated that the rib surface 144 is substantially flush with the finger outer surface 124 while the shoulder inner surface 134 is placed substantially flush with the collar inner surface 104. It is important that at least the collar inner surface 104 and the shoulder inner surface 134 be flush with one another as they form a portion of the chamber 32 which mandates that minimal turbulence be created between connecting parts so as to maintain an efficient airflow therethrough while the blower fan 38 rotates.

The motor housing 16 includes an end 150 which has an end inner surface 152 opposite an end outer surface 154. An end edge 156 interconnects the end inner surface 152 to the end outer surface 154. When the motor housing 16 is assembled to the side of the fan end bracket 12 opposite the blower shell 14, the end edge 156 is positioned adjacent to and bears upon the rim surface 110. Moreover, the end inner surface 152 is positioned adjacent the collar outer surface 106 and may also be placed in the bearing relationship therewith. It will also be appreciated that the end outer surface 154 is placed substantially flush with the finger outer surface 124 and the rib surface 144. The nested connection 44A may further be enhanced by tapering any or all of the above mating surfaces. For example, the collar outer surface 106 and the end inner surface 152 could be provided with substantially parallel tapers to assist in the angular alignment and attachment of the motor housing 16 to the fan end bracket 12. Likewise, the shoulder outer surface 136 may be tapered to better align with the taper surface 122.

Once the positional relationship of the adjacent surfaces of the fan end bracket 12, the blower shell 14 and the motor housing 16 is established, it will be appreciated that the nested connections 44A and 45 provide an axial, angular and radial alignment between the pieces that connect with one another. The foregoing structure facilitates assembly of the pieces to one another and ensures proper alignment of the motor 18 and the motor shaft 24 within the assembly 10. Accordingly, the present construction lends itself to high-speed assembly of the respective parts, minimizes the forces exerted by the shaft upon the bearings and reduces the noise thereof. Moreover, vibrations are captured within the radial alignment features and alleviate the pressure that would otherwise be exerted upon the fasteners 42. As a result, a more secure long-term motor assembly is fabricated.

Figure 4:
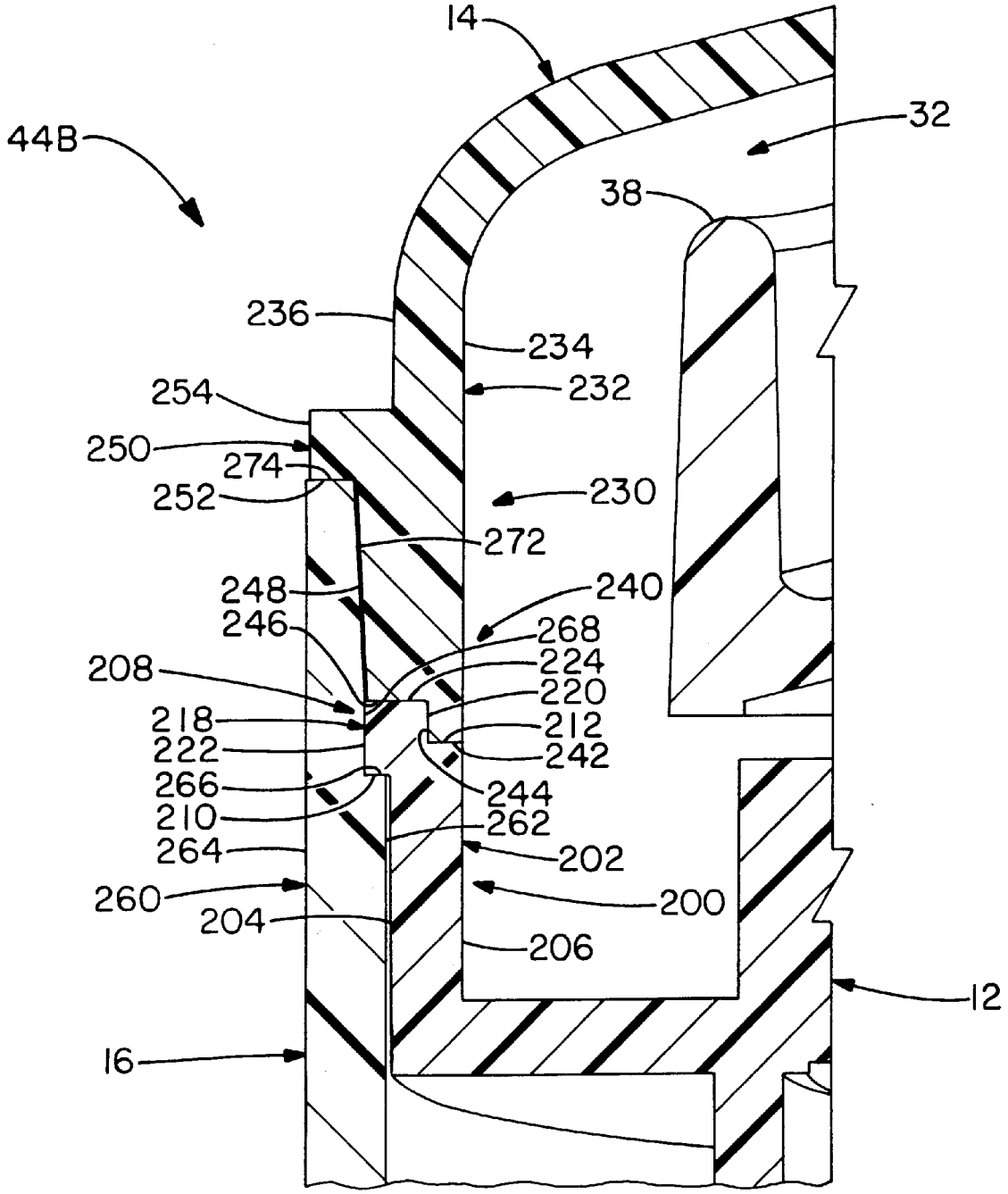
FIG. 4 is an enlarged cross-sectional view of a nesting connecting according to an alternative embodiment of the present invention.

An alternative embodiment of the present invention is presented in FIG. 4 which shows a nested connection 44B including a fan end bracket 12 with a modified bracket shiplap 200. In particular, the bracket shiplap 200 includes a collar 202 which provides a collar outer surface 204 opposite a collar inner surface 206. A rim 208 extends substantially perpendicularly from the collar 202 and provides a rim surface 210 that extends perpendicularly from the collar outer surface 204. The rim 208 also provides a collar end surface 212 which extends perpendicularly away from the collar inner surface 206. Extending substantially perpendicularly upwardly from the rim 208 is a finger 218 in a direction away from the collar 202. The finger 218 includes a finger inner surface 220 opposite a finger outer surface 222. A finger edge 224 joins the finger inner surface 220 to the finger outer surface 222.

Mated to the bracket shiplap 200 is a blower shiplap 230 of the blower shell 14. The blower shiplap 230 includes a shoulder 232 which provides a shoulder inner surface 234 opposite a shoulder outer surface 236. The shoulder inner surface 234 terminates at a stepped edge surface 240 that mates with the bracket shiplap 200. In particular, the stepped edge surface 240 includes a first edge portion 242 that is substantially perpendicular with the shoulder inner surface 234, a step wall 244 that extends substantially perpendicularly from the first edge portion 242, and a second edge portion 246 extends substantially perpendicularly from the step wall 244. Extending from the second edge portion 246 is a shoulder taper surface 248. Extending substantially perpendicularly outwardly from the shoulder outer surface 236 is a rib 250 which includes a stop edge 252 and a rib surface 254. The stop edge 252 extends angularly from the shoulder taper surface 248.

It will be appreciated then that the fan end bracket 12 is radially, axially and angularly aligned with the blower shell 14 by virtue of the position of the first edge portion 242 bearing against the collar end surface 212. Additionally, the step wall 244 is positioned adjacent and may abut against the finger inner surface 220 while the second edge portion 246 is positioned adjacent and may bear upon the finger edge 224. Of course, any one of these mating surfaces may be tapered.

The motor housing 16 is mated with the fan end bracket 12 and the blower shell 14 in this embodiment. In particular, the motor housing 16 includes an end 260 which provides an end inner surface 262 opposite an end outer surface 264. Extending substantially perpendicularly from the end inner surface 262 is a lip 266. An inner lip edge 268 extends substantially perpendicularly from the lip 266. Extending further from the inner lip edge 268 is a taper 272. An end edge 274 connects the taper 272 to the end outer surface 264.

When the motor housing 16 is assembled to the fan end bracket 12 and the blower shell 14, it will be appreciated that the end inner surface 262 is positioned adjacent and may bear against the collar outer surface 204. Likewise, the lip 266 is positioned adjacent and bears against the rim surface 210. The finger outer surface 222 is positioned and may bear against the inner lip edge 268. These positional relationships provide the nested connection 44B with an axial, radial and angular alignment between the fan end bracket 12 and the motor housing 16.

The motor housing 16 is nested with the blower shell 14 by virtue of the taper 272 being positioned adjacent and possibly bearing against the shoulder taper surface 248. It will be appreciated that the taper 272 and the shoulder taper surface 248 extend in a parallel relationship to one another. Moreover, these tapered surfaces allow for ease of insertion between the blower shell 14 and the motor housing 16 and further provide secure angular engagement between the blower shell 14 and the fan end bracket 12. The motor housing 16 also mates with the blower shell 14 by virtue of the end edge 274 being positioned and bearing against the stop edge 252. It will also be appreciated that the rib surface 254 is substantially flush with the end outer surface 264.

With the mating of the motor housing 16 to both the fan end bracket 12 and the blower shell 14, it will be appreciated that an axial, radial and angular alignment is provided between each of the three pieces. In particular, the lip 266 and lip inner edge 268 provide radial and axial alignment with the rim surface 210 and the finger outer surface 222, respectively. Additionally, the motor housing 16 is radially, axially and angularly aligned with the blower shell 14 by virtue of the taper 272 being adjacent and possibly bearing against the shoulder taper surface 248, and by virtue of end edge 274 bearing against the stop edge 252. A radial and axial alignment is also provided between the fan end bracket 12 and the blower shell 14 by virtue of the stepped edge surface 240 being positioned adjacent and bearing upon the collar inner surface 212, the finger inner surface 220, and the finger edge 224.

The nested connection 44B presented in FIG. 4 provides all of the same advantages of the nest connection shown and described in FIG. 3. The nested connection 44B provides a further advantage of interconnecting all three of the major components to one another around the cylindrical periphery of the motor frame assembly 10.

Thus, it can be seen that the objects of the invention have been satisfied by the structure and use of the invention as presented above. While in accordance with the Patent Statutes, only the best mode of the invention has been presented and described in detail, it is to be understood that the invention is not limited thereto or thereby. Accordingly, for an appreciation of the true scope and breadth of the invention, reference should be made to the following claims.

What is claimed is:

1. A motor frame assembly, comprising:

a motor housing having an end;

a fan end bracket having a bracket shiplap; and a blower assembly having a blower shiplap, wherein said motor housing end, said bracket shiplap and said blower shiplap are alignable with each other to form a nested connection that provides at least radial and axial alignment with each other.

2. The motor frame assembly according to claim 1, wherein said bracket shiplap comprises:

a collar having a collar outer surface opposite a collar inner surface;

a rim extending from said collar, said rim having a rim surface extending from said collar outer surface and a collar end surface extending from said collar inner surface; and a finger extending from said rim, said finger having a finger inner surface extending from said collar end surface and a finger outer surface extending from said rim surface, said finger inner surface connected to said finger outer surface by a finger edge.

3. The motor frame assembly according to claim 2, wherein said blower shiplap comprises:

a shoulder having a shoulder outer surface opposite a shoulder inner surface, and a shoulder edge connecting said shoulder outer surface to said should inner surface; and a rib extending from said shoulder outer surface, said rib having a stop edge.

4. The motor frame assembly according to claim 2, wherein said motor housing end comprises: an inner surface opposite an outer surface connected by an end edge.

5. The motor frame assembly according to claim 2, wherein said blower shiplap comprises a shoulder having a shoulder outer surface opposite a shoulder inner surface, a shoulder edge connecting said shoulder outer surface to said shoulder inner surface, and a rib extending from said shoulder outer surface, said rib having a stop edge;

said motor housing end comprising an end inner surface opposite an end outer surface connected by an end edge; and wherein said nested connection positions said collar outer surface adjacent said end inner surface, positions said end edge adjacent said rim surface, positions said collar end surface adjacent said shoulder edge, positions said finger inner surface adjacent said shoulder outer surface, and positions said finger edge adjacent said stop edge.

6. The motor frame assembly according to claim 5, further comprising a taper surface extending from said finger inner surface to assist in forming said nested connection.

7. The motor frame assembly according to claim 2, wherein said blower shiplap comprises:

a shoulder having a shoulder inner surface opposite a shoulder outer surface;

a stepped edge surface connecting said shoulder inner surface to said shoulder outer surface, said stepped edge surface including a first edge portion connected to a second edge portion by a step wall; and a rib extending from said shoulder outer surface, said rib having a stop edge extending from said shoulder outer surface.

8. The motor frame assembly according to claim 2, wherein said motor housing end comprises an end edge extending from an end outer surface;

a lip extending from an end inner surface; and an inner lip edge extending from said lip and said end edge.

9. The motor frame assembly according to claim 2 wherein said blower shiplap comprises a shoulder having a shoulder inner surface opposite a shoulder outer surface, a stepped edge surface connecting said shoulder inner surface to said shoulder outer surface, said stepped edge surface including a first edge portion connected to a second edge portion by a step wall, and a rib extending from said shoulder outer surface, said rib having a stop edge extending from said shoulder outer surface;

said motor housing end comprises an end edge extending from an end outer surface, a lip extending from an end inner surface, and an inner lip edge extending from said lip and said end edge; and wherein said nested connection positions said collar outer surface adjacent said end inner end surface, positions said collar end surface adjacent said lip, positions said lip inner edge surface adjacent said finger outer surface, positions said rim surface adjacent said first edge portion, positions said finger inner surface adjacent said step wall, positions said finger edge adjacent said second edge portion, positions said end taper surface adjacent said shoulder outer surface, and positions said end edge adjacent said stop edge.

* * * * *